United States Patent [19]

Siniscalchi

[11] Patent Number: 4,551,383

[45] Date of Patent: Nov. 5, 1985

[54] PROCESS FOR THE PRODUCTION OF PADDING FOR CLOTHING OR FURNISHINGS AND PRODUCT

[76] Inventor: Luciano Siniscalchi, Via Milano, 53, 22059 - Robbiate (Como), Italy

[21] Appl. No.: 686,833

[22] Filed: Dec. 27, 1984

[30] Foreign Application Priority Data

May 17, 1984 [IT] Italy ..... 20978 A/84

[51] Int. Cl.[4] ..... D04H 1/58

[52] U.S. Cl. ..... 428/286; 156/296; 156/344; 428/288; 428/920

[58] Field of Search ..... 156/622, 296, 344, 183, 156/, 292, 324; 2/272; 428/286, 288, 311.1, 166, 178, 920

[56] References Cited

U.S. PATENT DOCUMENTS

| | | | |
|---|---|---|---|
| 3,879,257 | 4/1975 | Gertile et al. | 156/183 |
| 4,199,642 | 4/1980 | Cooper et al. | 428/288 |
| 4,304,817 | 12/1981 | Frankosky | 428/288 |
| 4,400,426 | 8/1983 | Aldrich | 428/288 |
| 4,477,515 | 10/1984 | Masuda | 428/288 |

*Primary Examiner*—Michael Ball

*Attorney, Agent, or Firm*—Bucknam and Archer

[57] ABSTRACT

A process for the production of padding for clothing or furnishing is discussed. The process involves the use of synthetic or other fibres, and padding formed by the process comprises a mixture of fibres, preferably polyester or other, with silicone treated fibres of various nature and origin, from which, by means of carding machines, a layer or web is produced. This layer or web is treated on one face, with a mixture of sticky plastic adhesives and subsequently is passed through a calender having two or more suitably heated cylinders which reduces the thickness of the layer itself.

At the output of the cylinders of the calender the web remains, for a short time, adhering with its sticky surface to the corresponding cylinder, which causes a slight expansion to take place resulting in the formation of air pockets in the web.

7 Claims, 3 Drawing Figures

PROCESS FOR THE PRODUCTION OF PADDING FOR CLOTHING OR FURNISHINGS AND PRODUCT

BACKGROUND OF THE INVENTION

The present invention relates to a process for the production of padding in synthetic fibres, which is usable both for clothing and furnishings in general, in particular in the manufacture of windcheater jackets. The present invention also comprehends padding obtained by means of this process.

Windcheater jackets are currently provided with a padding of insulating material which increases their natural insulating characteristics. This padding can be advantageously constituted by layers of cohered synthetic fibres (non woven fabric) usually polyproplyene or polyester although other fibres may be used instead or included in a mixture. For styling and aesthetic reasons it is a requirement for such purposes that the padding should not be too thick, whilst nevertheless providing the required insulating properties.

For the purpose of obtaining such reduced thickness traditional wadding is currently produced of a very low weight per square meter, (40,50 or 60 g/m$^2$), alternatively the wadding may be stitched to try and reduce its thickness. This latter operation causes a limited squashing of the wadding itself, but significantly hardens it, limiting the possible softness of the padded finished garments or articles.

Even so the layers of padding thus obtained have only relatively low values of thermal insulation and do not have the necessary characteristics of finish.

Moreover, it should be noted that the insulation value of layers of the padding is determined, among other things, by the correct ratio between the density of the wadding and the quantity of air trapped between the fibres. Consequently, if it is desired to obtain products having a high thermal insulation using only conventional techniques it is necessary considerably to increase the weight and therefore the thickness of the starting material. This, however, leads to an unwanted increase in the volume of the product, such as to prejudice the line of the finished product, for example a windcheater jacket.

OBJECTS OF THE INVENTION

The primary object of the present invention is to provide a process for the production of padding having a high thermal insulation value and a low thickness, even if it is of high weight.

Another object of the present invention is to provide a padding material which is compact and the nap of which is well secured on both faces—(so that fibres do not project through the covering fabric).

A further object of the present invention is to provide a padding material which, whilst having the same thermal insulation properties a currently produced conventional padding, will have a noticably smaller thickness than that of similar products which are currently commercially available.

SUMMARY OF THE INVENTION

According to one aspect of the present invention there is provided, in a process for the production of padding in synthetic or other fibres, the improvement comprising the steps of:

first producing a web including a layer obtained by carding a mixture of fibres of polyester or other fibres with silicone treated fibres of diverse nature and origin;

treating one side of said web with a mixture of bonding agents of stickly plastic consistency which, when polymerised, create a very soft and elastic film;

spray-applying on the opposite side of said web from said one side thereof another type of bonding agent, of different nature, which is not sticky;

passing said web, thus treated, through a calender composed of two or more cylinders; and heating said cylinders whereby to cause said sticky plastic bonding agent to adhere to the facing roller in the region of separation of said web from said rollers such that said layer of fibres as caused partially to separate to create air spaces therein.

By suitably regulating the pressure and the temperature of the cylinders, a desired and adjustable reduction of thickness can be obtained, and, simultaneously, the effect of the adhesion of the plastic side of the adhesive layer as the layer is being separated from the cylinder, there takes place a slight reinflation which creates an "air chamber" or air pocket within the layer.

It is suitable, by the way, to underline the fact that the formation of the air chamber or air pocket is also favoured by the presence of the silicone treated and therefore slippery fibres. This process makes it possible to reduce to the desired thicknesses paddings having very high weight per square meter, which constitutes a considerable advantage as far as use of the padding for garments is concerned.

Another advantage is represented by the possibility of obtaining, by means of the calendering operation, more or less any thickness of finished padding from a single given material starting thickness by appropriately varying the temperature and pressure of the cylinder.

According to another aspect, the present invention provides padding when produced by the process of the invention.

Further characteristics and advantages of the process for the production of padding, which constitutes the subject of the present invention, will be better understood from a study of the following description in which reference will be made to the attached drawing, which is provided purely by way of non limitative example.

DESCRIPTION OF THE PREFERRED EMBODIMENT

Figure 1:
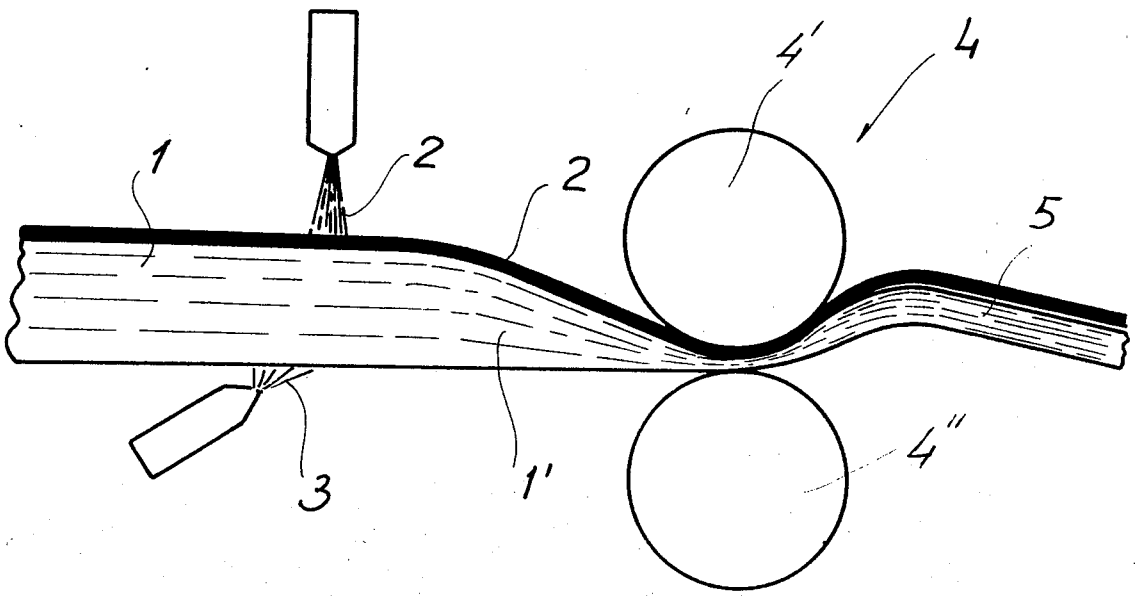
FIG. 1 is a shematic side view of a web of padding material undergoing the process of the invention.

Referring now to the drawings, the process for the production of padding can be performed on webs of layers comprising a mixture of polyester or other fibres with silicone treated fibres of different nature and origin.

This mixture of fibers, by means of carding machines, is formed into a layer 1, which is resin bonded with a mixture of adhesives for the purpose of making it more compact and for fixing the nap.

More specifically, there are used two mixtures of adhesives: a first sticky plastic adhesive 2 which, when polymerised, creates a very soft and elastic film on one side of the padding; on the other side, there is sprayed another type of adhesive, of different nature, which is not sticky, 3.

The product which results from this has a soft and voluminous aspect; however, for the requirements of fashion or for other requirements, there exists the necessity of having the product in layers of high weight per square meter, and therefore of high insulating property, but reduced a thickness. To achieve this the layer of padding 1', produced as described above, is made to pass through a calender, generally indicated 4, composed of two or more cylinders, heated to a chosen temperature. In particular, one of the cylinders or of each pair of cylinders if there is more than one pair (the lower cylinder as viewed in the drawings) is completely smooth and made of metal, whilst the other is clad with a material of a different, nature, which is not smooth.

By suitably adjusting the pressure and the temperature and arranging that the sticky plastic side of the layer faces towards the coated cylinder, the desired reduction in the thickness is obtained, and simultaneously, by the effect of the adhesion of the sticky plastic side of the layer itself to the cylinder in the region of separation from the cylinder, there occurs a slight reinflation which creates an "air chamber" or air pocket.

Alternatively, of course, the said calender could be constituted by entirely metal cylinders, or other non-clad materials. The presence of a layer, however thin, of adhesive, on one face of the layer, makes this latter adhere, at least over a certain section, to the facing cylinder. In practice, the expansion of the compressed material caused by this adhesion is controllable, and serves to create, in the material itself, zones of discontinuity, which reduce its specific weight and increase its thermal resistance. Thus it can be seen that the product thus obtained is able to offer a high thermal resistance without by this presenting excessive thickness.

Figures 2, 3:
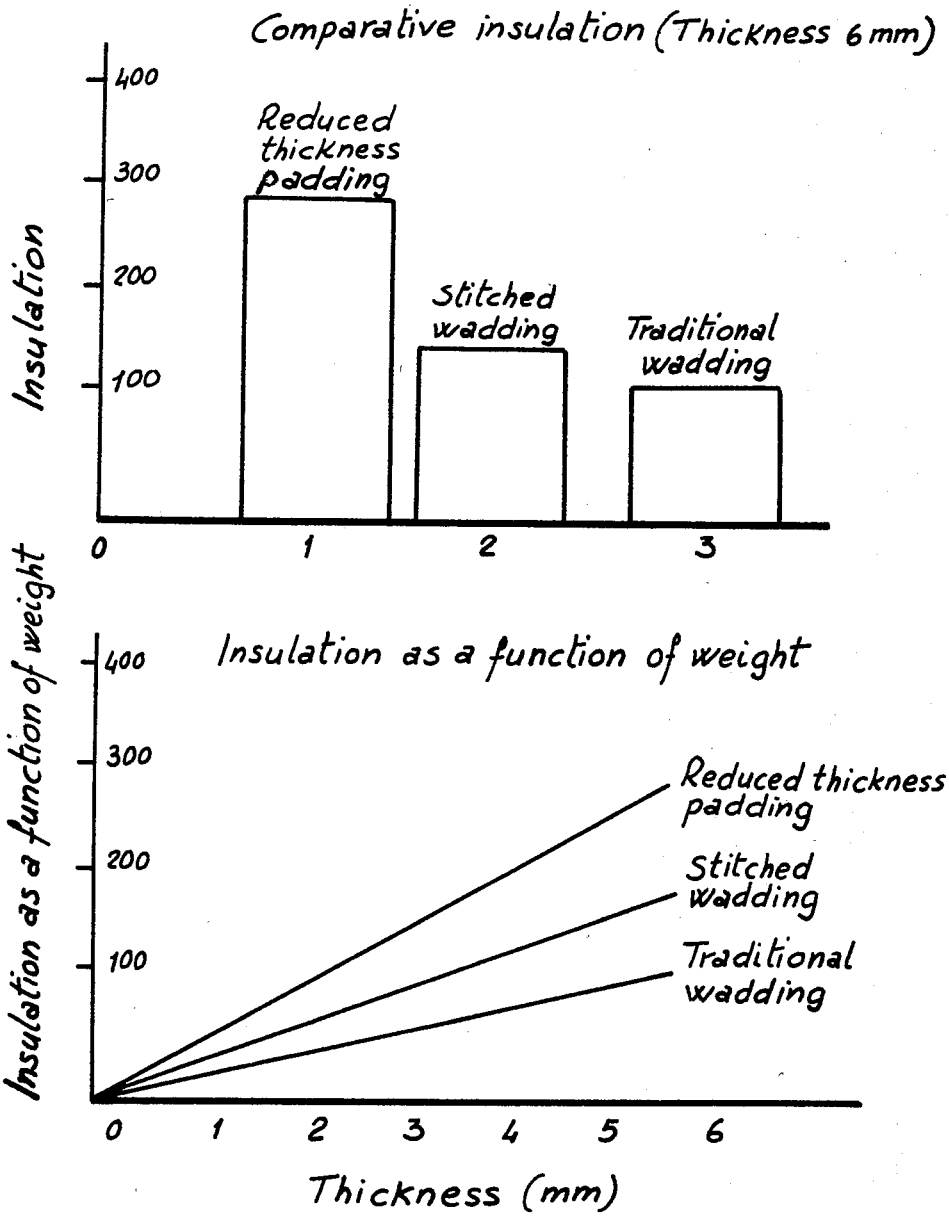
FIG. 2 is a histogram illustrating the insulating properties of the product of the present invention in comparison with known materials at a given thickness.
FIG. 3 is a graph illustrating the variation of insulation property with thickness for the same materials as in FIG. 2.

FIG. 2 illustrates, by way of example, the different insulation properties of three products, all produced starting from layers of superimposed cohered fibres of polyester, and all having the same weight per unit of surface area but of course all having different thicknesses, the thinnest being the product according to the invention. The same information is summarised in the following table:

| Product | Traditional Wadding | Stitched Wadding | Product of the invention |
|---|---|---|---|
| Thickness | 0.6 mm | 0.6 mm | 0.6 mm |
| Weight in grammes | 30 | 50 | 120 |
| Insulation Traditional wadding + 100 | 100 | 130 | 290 |

For such products, the insulation detected by suitable tests, is illustrated in FIG. 3 of the drawings, which is a graph illustrating the variation of the insulation property with thickness for various different materials which also shows that, at any given thickness the product of the present invention provides much greater insulation.

From what has been explained above and from observation of the attached figures the great functionality and practicality in use which characterises the padding of synthetic fibres obtained by means of the process constituting the subject of the present invention will be apparent.

Obviously, such process has been described and illustrated above purely by way of indicative and non limitative example, and only for the purpose of demonstration of practicability and characteristics of the present invention, so that many variations and modifications will be apparent to an expert in the art which may be introduced without departing from the spirit and scope of the invention as defined in the following claims.

What is claimed is:

1. In a process for the production of padding in synthetic or other fibres, the improvement comprising the steps of:

first producing a web including a layer obtained by carding a mixture of fibres of polyester or other fibres with silicone treated fibres of diverse nature and origin;

treating one side of said web with a mixture of bonding agents of sticky plastic consistency which, when polymerised, create a very soft and elastic film;

spray-applying in the opposite side of said web from said one side thereof another type of bonding agent, of different nature, which is not sticky;

passing said web, thus treated through a calender composed of two or more cylinders; and heating said cylinders whereby to cause said sticky plastic bonding agent to adhere to the facing roller in the region of separation of said web from said rollers such that said layer of fibres as caused partially to separate to create air spaces therein.

2. The process for the production of padding, of claim 1, wherein one of said cylinders of said calender is completely smooth and made of metal, whilst the other is clad with a material of different nature which is not smooth.

3. The process of claim 1, wherein the cylinders of the calender are all constituted by entirely metal cylinders.

4. Synthetic fibre padding made by means of the process of claim 1 wherein said layer contains a plurality of discontinuities distributed between the fibres of the material, which constitute air pockets to act as barriers to the passage of heat.

5. The synthetic fibre padding of claim 4, wherein said layer of fibres has a compact structure with the nap well fixed on both faces.

6. The synthetic fibre padding of claim 5, wherein said fibres are polyester fibres and said layer has a thickness after calendering of 0.6 mm and a weight of 120 gms per square meter.

7. The synthetic fibre padding of claim 6, wherein the instulation value of said padding is 290 referred to a value of 100 for traditional wadding of the same thickness.

* * * * *